US009605674B2

(12) United States Patent
Forni et al.

(10) Patent No.: US 9,605,674 B2
(45) Date of Patent: Mar. 28, 2017

(54) VACUUM SCROLL PUMP HAVING PRESSURE-BALANCED ORBITING PLATE SCROLL

(71) Applicant: AGILENT TECHNOLOGIES, INC., Loveland, CO (US)

(72) Inventors: Ronald J. Forni, Lexington, MA (US); John Calhoun, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 540 days.

(21) Appl. No.: 14/140,591

(22) Filed: Dec. 26, 2013

(65) Prior Publication Data

US 2015/0184656 A1 Jul. 2, 2015

(51) Int. Cl.

| | |
|---|---|
| ***F04C 18/02*** | (2006.01) |
| ***F04C 29/00*** | (2006.01) |
| ***F04C 25/02*** | (2006.01) |

(52) U.S. Cl.

CPC ..... *F04C 18/0215* (2013.01); *F04C 25/02* (2013.01); *F04C 29/0021* (2013.01); *F04C 29/0057* (2013.01)

(58) Field of Classification Search

CPC ..... F04C 29/0021; F04C 29/0057; F04C 18/0215

See application file for complete search history.

(56) References Cited

U.S. PATENT DOCUMENTS

| | | | | |
|---|---|---|---|---|
| 4,669,962 | A | 6/1987 | Mizuno et al. | |
| 8,998,595 | B2 * | 4/2015 | Ito | F04C 18/0215 418/55.2 |
| 2008/0193311 | A1 | 8/2008 | Helies | |
| 2012/0164014 | A1 * | 6/2012 | Nagahara | F04C 18/0215 418/55.1 |

OTHER PUBLICATIONS

Search Report mailed Oct. 14, 2014 in Application No. GB1401856.8.

* cited by examiner

*Primary Examiner* — Mary A Davis

(57) ABSTRACT

A vacuum scroll pump has a frame, a stationary plate scroll fixed to the frame, an orbiting plate scroll, an eccentric drive mechanism for driving the orbiting plate scroll, and counterbalancing features by which axial loads produced on the eccentric drive mechanism are offset. Scroll blades of the stationary and orbiting plate scrolls are nested to define pockets which constitute a compression stage between opposing front sides of plates of the stationary and orbiting plate scrolls. The counterbalancing features include an axial counterbalancing chamber defined at a back side of the plate of the orbiting plate scroll, i.e., opposite the side at which the compression stage is provided, and a mechanism by which an intermediate one of the pockets can be placed in communication with the counterbalancing chamber through the plate of the orbiting plate scroll.

20 Claims, 8 Drawing Sheets

VACUUM SCROLL PUMP HAVING PRESSURE-BALANCED ORBITING PLATE SCROLL

BACKGROUND OF THE INVENTION

1. Field of the Invention

The present invention relates to vacuum scroll pumps.

2. Description of the Related Art

A scroll pump is a type of pump that includes a stationary plate scroll having a spiral stationary scroll blade, an orbiting plate scroll having a spiral orbiting scroll blade, and an eccentric driving mechanism to which the orbiting plate scroll is coupled. The stationary and orbiting scroll blades are nested with a radial clearance and predetermined relative angular positioning such that a pocket (or pockets) is delimited by and between the blades. The orbiting scroll plate and hence, the orbiting scroll blade, is driven by the eccentric driving mechanism to orbit about a longitudinal axis of the pump passing through the axial center of the stationary scroll blade. As a result, the volume of the pocket(s) delimited by the scroll blades of the pump is varied as the orbiting scroll blade moves relative to the stationary scroll blade. The orbiting motion of the orbiting scroll blade also causes the pocket(s) to move within the pump head assembly such that the pocket(s) is selectively placed in open communication with an inlet and outlet of the scroll pump.

In an example of such a scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. Then the pocket is moved to a position at which it is sealed off from the inlet of the pump and is in open communication with the outlet of the pump, and at the same time the pocket is contracted. Thus, the fluid in the pocket is compressed and thereby discharged through the outlet of the pump.

In the case of a vacuum-type of scroll pump, the inlet of the pump is connected to a system that is to be evacuated, e.g., a system including a processing chamber in which a vacuum is to be created and/or from which gas is to be discharged.

SUMMARY OF THE INVENTION

One object of the present invention is to provide a vacuum scroll pump in which axial loads exerted in one direction on an orbiting plate scroll of the pump are counteracted.

Another object of the present invention is to provide a vacuum scroll pump whose eccentric drive mechanism may employ relatively simple bearing architecture.

Still another object of the present invention is to provide a vacuum scroll pump whose bearings enjoy a relatively long useful life.

According to one aspect of the invention, there is provided a vacuum scroll pump having an inlet portion having a pump inlet, an exhaust portion having a pump outlet, a frame, a stationary plate scroll fixed to the frame, an orbiting plate scroll whose scroll blade is nested with that of the stationary plate scroll to define a series of pockets constituting a compression stage, an eccentric drive mechanism supported by the frame and operatively connected to the orbiting plate scroll to drive the orbiting plate scroll in an orbit about a longitudinal axis of the pump, and counterbalancing features by which axial loads produced on the eccentric drive mechanism are offset.

According to still another aspect of the inventive concept, there is provided a vacuum scroll pump having an inlet portion having a pump inlet, an exhaust portion having a pump outlet, a frame, a stationary plate scroll fixed to the frame, an orbiting plate scroll whose scroll blade is nested with that of the stationary plate scroll to define a series of pockets constituting a compression stage, an eccentric drive mechanism supported by the frame and operatively connected to the orbiting plate scroll to drive the orbiting plate scroll in an orbit about a longitudinal axis of the pump and which mechanism includes a crankshaft and spring-loaded angular contact bearings disposed on the crankshaft, a tubular bellows extending around the eccentric drive mechanism and having a first end connected to the orbiting plate and a second end connected to the frame, and counterbalancing features by which axial loads produced on the eccentric drive mechanism are offset.

With respect to the counterbalancing features, an axial counterbalancing chamber is defined within the frame as aligned in the direction of the longitudinal axis with part of the back side of the plate of the orbiting plate scroll. In addition, the plate of the orbiting plate scroll has a gas bypass passage connecting the counterbalancing chamber and an intermediate one of the pockets that constitute the compression stage. Still further, axial gas force control means are provided for selectively placing the intermediate pocket of the compression stage in open communication with the counterbalancing chamber and for closing off communication between the intermediate pocket and the counterbalancing chamber, via the gas bypass passage.

BRIEF DESCRIPTION OF THE DRAWINGS

These and other objects, features and advantages of the present invention will be better understood from the detailed description of the preferred embodiments thereof that follows with reference to the accompanying drawings, in which.

DETAILED DESCRIPTION OF THE PREFERRED EMBODIMENTS

Figure 1:
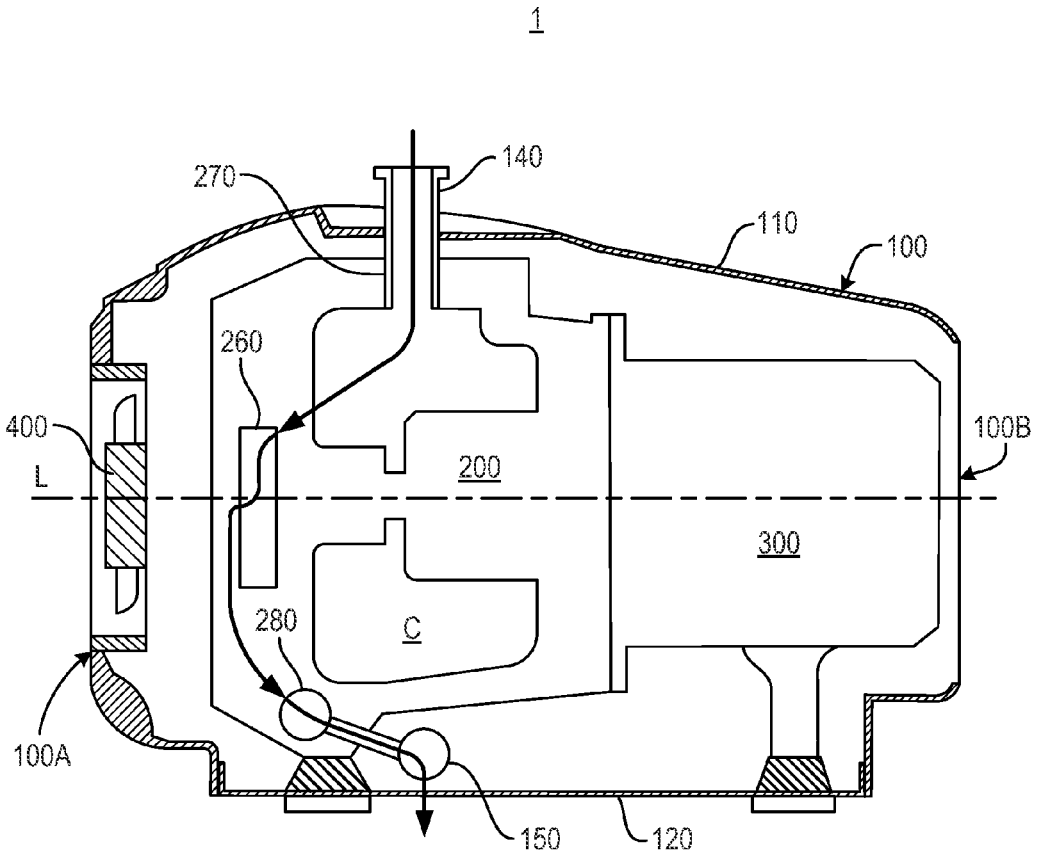
FIG. 1 is a schematic longitudinal sectional view of a scroll pump to which the present invention may be applied.

Various embodiments and examples of embodiments of the invention will be described more fully hereinafter with reference to the accompanying drawings. In the drawings, the sizes and relative sizes of elements may be exaggerated for clarity. Likewise, the shapes of elements may be exaggerated and/or simplified for clarity and elements may be shown schematically for ease of understanding. Also, like numerals and reference characters are used to designate like elements throughout the drawings.

Other terminology used herein for the purpose of describing particular examples or embodiments of the invention is to be taken in context. For example, the term "comprises" or "comprising" when used in this specification indicates the presence of stated features or processes but does not preclude the presence of additional features or processes. Terms such as "fixed" may be used to describe a direct connection of two parts/elements to one another in such a way that the parts/elements can not move relative to one another or an indirect connection of the parts/elements through the intermediary of one or more additional parts. Likewise, the term "coupled" may refer to a direct or indirect coupling of two parts/elements to one another. The term "delimit" is understood to mean provide a boundary. The term "spiral" as used to described a scroll blade is used in its most general sense and may refer to any of the various forms of scroll blades known in the art as having a number of turns or "wraps".

A first embodiment of a vacuum scroll pump according to the present invention will now be described with reference to FIGS. 1-3.

Referring first to FIG. 1, a vacuum scroll pump 1 to which the present invention can be applied may include a cowling 100, and a pump head assembly200 having an inlet opening 270 and an exhaust opening 280, a pump motor 300, and a cooling fan 400 disposed in the cowling 100. Furthermore, the cowling 100 defines an air inlet 100A and an air outlet 100B at opposite ends thereof, respectively. The cowling 100 may also include a cover 110 that covers the pump head assembly 200 and pump motor 300, and a base 120 that supports the pump head assembly 200 and pump motor 300. The cover 110 may be of one or more parts and is detachably connected to the base 120 such that the cover 110 can be removed from the base 120 to access the pump head assembly 200. Furthermore, the motor 300 is detachably connected to the pump head assembly 200 so that once the cover 110 is removed from the base 120, for example, the motor 300 can be removed from the pump head assembly 200 to provide better access to the pump head assembly 200 for maintenance and/or troubleshooting.

Figure 2:
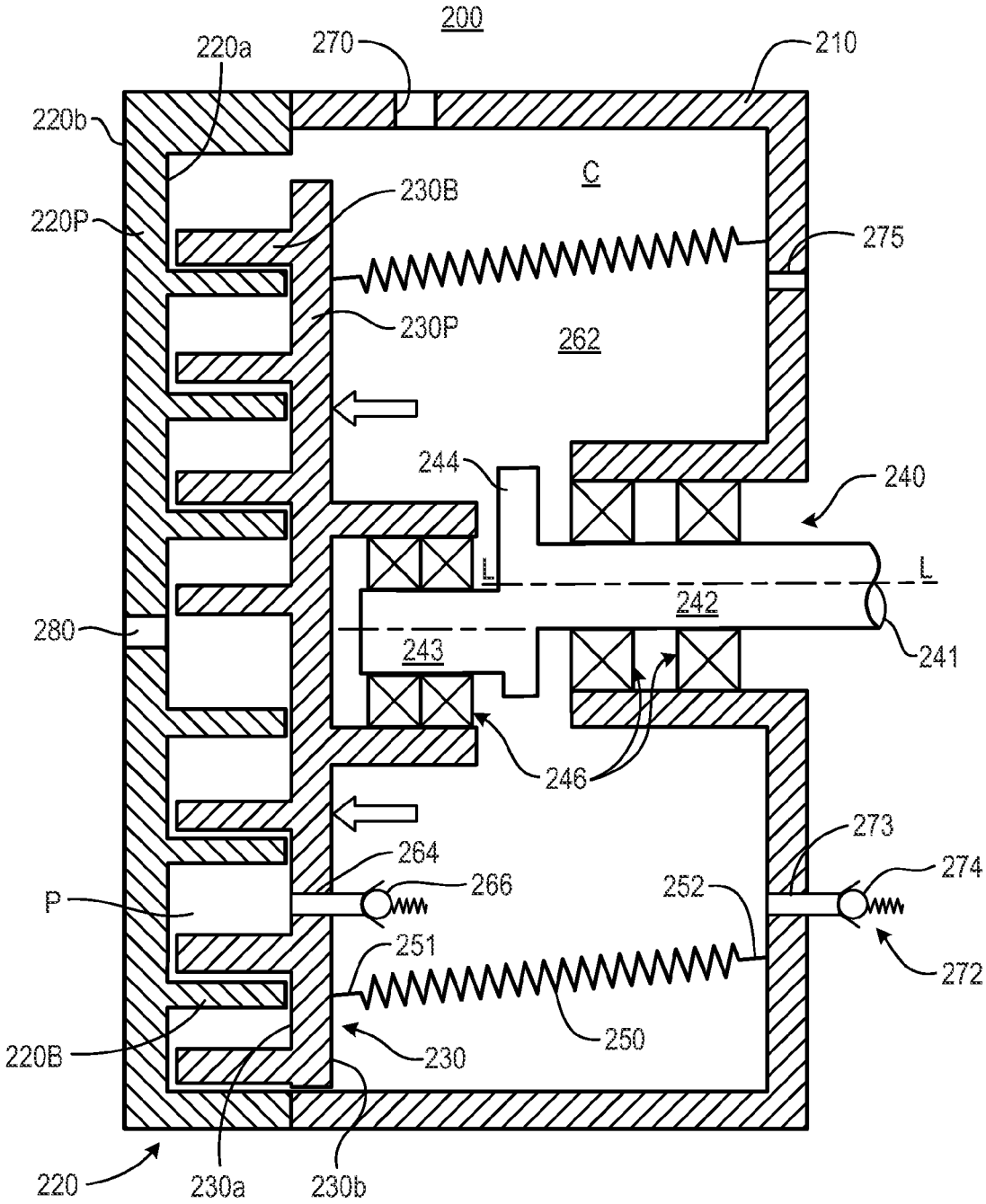
FIG. 2 is a schematic longitudinal sectional view of a pump head of a first embodiment of a scroll pump according to the present invention.

Referring now to FIG. 2, a pump head 200 of one embodiment of the vacuum scroll pump 1 includes a frame 210, a stationary plate scroll 220, an orbiting plate scroll 230, and an eccentric drive mechanism 240.

The frame 210 may be one unitary piece, or the frame 210 may comprise several integral parts that are fixed to one another.

The stationary plate scroll 220 in this example is detachably mounted to the frame 210 (by fasteners, not shown). The stationary plate scroll 220 includes a stationary plate 220P having a front side 220*a* and a back side 220*b*, and a stationary scroll blade 220B projecting axially from the front side 220*a* of the plate 220P. The stationary scroll blade 220B is in the form of a spiral having a number of wraps emanating from the axial center of the stationary plate scroll 220, as is known per se. The orbiting plate scroll 230 includes an orbiting plate 230P having a front side 230*a* and a back side 230*b*, and an orbiting scroll blade 230B projecting axially from the front side 230*a* of the plate 230P. The orbiting scroll blade 230B has wraps emanating from the axial center of the orbiting plate scroll 230 and which are complementary to those of the stationary scroll blade 220B.

Figure 3:
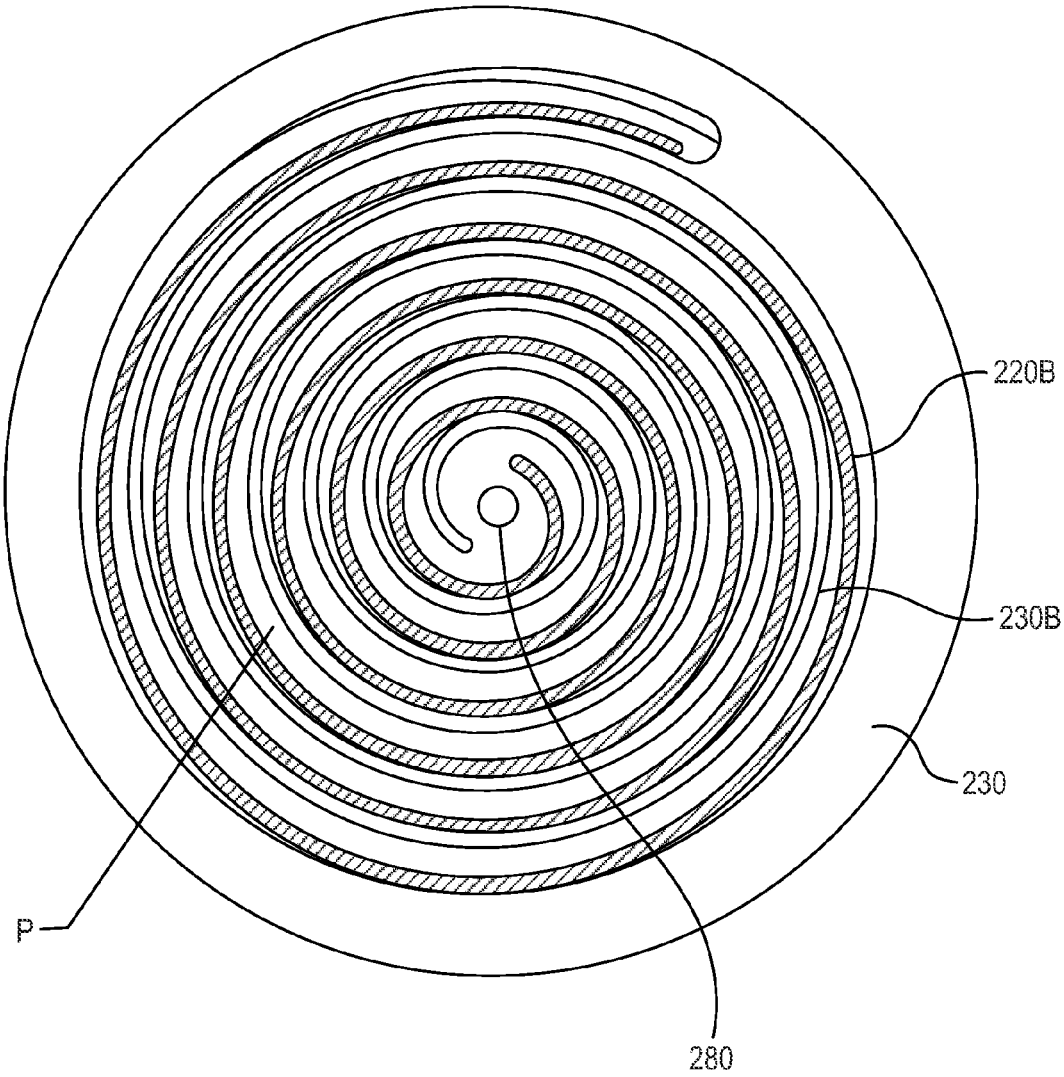
FIG. 3 is an assembly view of stationary and orbiting plate scrolls of a vacuum scroll pump according to the present invention.

The stationary scroll blade 220B and the orbiting scroll blade 230B are nested, as shown in FIGS. 2 and 3, with a predetermined relative angular and axial positioning such that pockets (one of which is labeled P) are delimited by and between the stationary and orbiting scroll blades 220B and 230B during operation of the pump to be described in detail below. The pockets P are disposed in series as between the inlet opening 270 and the exhaust opening 280 and collectively constitute a compression stage 260 (FIG. 1) of the pump. Further in this respect, the sides of the scroll blades 220B and 230B may not actually contact each other to seal the pockets P. Rather, minute clearances between sidewall surfaces of the scroll blades 220B and 230B along with tip seals (not shown) create seals sufficient for forming satisfactory pockets P. Seals are also provided between the tips of the stationary and orbiting scroll blades 220B and 230B and the opposing front sides 230*a* and 220*a* of the orbiting and stationary plates 230P and 220P, respectively. To this end, the stationary and orbiting scroll plates 220 and 230 are essentially fixed in place axially relative to each other.

The eccentric drive mechanism 240 includes a crankshaft 241 and a number of bearings 246. The crankshaft 241 has a main portion 242 coupled to the motor 300 so as to be rotated by the motor 300 about a longitudinal axis L of the pump 1, a crank 243 whose central longitudinal axis is offset in a radial direction from the longitudinal axis L, and a counterweight 244.

The main portion 242 of the crankshaft 241 is supported by the frame 210 via one or more sets of the bearings 246 so as to be rotatable relative to the frame 210, and the orbiting plate scroll 230 is mounted to the crank 243 via at least one other bearing 246. Thus, the orbiting plate scroll 230 is carried by crank 243 so as to orbit about the longitudinal axis L of the pump when the main shaft 242 is rotated by the motor 300, and the orbiting plate scroll 230 is supported by the crank 243 so as to be rotatable about the central longitudinal axis of the crank 243.

The pump head 200 also has a metallic bellows 250 whose ends 251 and 252 are connected to the orbiting plate scroll 230 and frame 210, respectively. During a normal operation of the pump, a load applied to the orbiting scroll blade 230B, due to the fluid being compressed in the pockets, tends to act in such a way as to cause the orbiting scroll plate 230 to rotate about the central longitudinal axis of the crank 243. However, the bellows 250 restrains the orbiting plate scroll 230 in such a way as to allow it to orbit about the longitudinal axis L of the pump while inhibiting its rotation about the central longitudinal axis L of the pump. More specifically, the bellows 250 is radially flexible enough to allow the first end 251 thereof to follow along with the orbiting plate scroll 230 while the second end 252 of the bellows remains fixed to the frame 210. Furthermore, the metallic bellows 250 has some flexibility in the axial direction, i.e., in the direction of its central longitudinal axis. On the other hand, the metallic bellows 250 may have a torsional stiffness that prevents the first end 251 of the bellows 250 from rotating significantly about the central longitudinal axis of the bellows 250, i.e., from rotating significantly in its circumferential direction, while the second end 252 of the bellows 250 remains fixed to the frame 210. Accordingly, the metallic bellows 250 may in some cases provide the angular synchronization between the stationary and orbiting scroll blades 220B and 230B, respectively, during the operation of the pump.

In addition the bellows 250 also extends around the eccentric drive mechanism 240 (namely, the crankshaft 241 and the bearings 246). In this way, the bellows 250 seals the bearings 246 and bearing surfaces from a space defined between the bellows 250 and the frame 210 in the radial direction. This space may constitute a vacuum chamber C of the pump. Accordingly, lubricant employed by the bearings 246 and/or particulate matter generated by the bearing surfaces can be prevented from passing into the vacuum chamber C by the bellows 250.

Referring back to FIG. 1, the vacuum scroll pump 1 also has a pump inlet 140 and constituting a vacuum side of the pump where fluid is drawn into the pump, and a pump outlet 150 and constituting a compression side where fluid is discharged to atmosphere or under pressure from the pump. The inlet opening 270 of the pump head 200 connects the inlet 140 of the pump to the vacuum chamber C, and the exhaust opening 280 leads to the pump outlet 150. Thus, it may be considered that the portion of the pump from the pump inlet 140 to the inlet opening 270 of the pump head 280 is an inlet portion of the pump, and the portion of the pump from the exhaust opening 280 to the pump outlet 150 is an exhaust portion of the pump.

A problem that can arise in a vacuum scroll pump of the type to which the present invention applies, in which a bellows is used, is the potential for a reversing axial load on the orbiting plate 230P. When the scroll pump is operated under a condition in which a vacuum exists in the pump inlet 140, or when the pump outlet 150 is connected to a backing pump, a net force acts on the orbiting plate 230P in an axial direction that tends to push the orbiting plate 230P towards the stationary plate 220P (i.e., toward what can be considered as constituting an outboard housing). On the other hand, when the pump is vented and the pressure in the pump inlet 140 is at atmospheric pressure, a net force acts on the orbiting plate 230P in an axial direction that tends to push the orbiting plate 230P away from the stationary plate 220P (i.e., away from the outboard housing).

This reversing axial gas load can cause problems with the bearings of the eccentric drive mechanism and necessitate relatively complex bearing architecture. On the other hand, if the axial gas load were only in a single direction, a relatively simple bearing architecture could handle the load and the life of the bearings would be prolonged. With respect to the latter, it is known that the fatigue life of a bearing (depending on the type of bearing) is roughly proportional to the load on the bearing raised to the 10/3 power. Therefore, a 50% reduction in the load on the bearing could increase the life of the bearing by a factor of 10.

According to an aspect of the invention, the bellows 250 is used to delimit a pressure balancing chamber 262 (referred to hereinafter as a counterbalancing chamber) within the frame as aligned in the direction of the longitudinal axis with part of the back side 230*b* of the orbiting plate 230P. Furthermore, the orbiting plate 230P has a gas bypass passage 264 connecting the counterbalancing chamber 262 and an intermediate one of the series of pockets P that constitute the compression stage 260.

In addition, an axial gas force control means is provided for selectively placing the aforementioned intermediate pocket P in open communication with the counterbalancing chamber 262 and for closing off communication between the intermediate pocket P and the counterbalancing chamber 262, via the gas bypass passage 264. The axial gas force control means may be a spring-loaded check valve 266 disposed in-line with the gas bypass passage 264 between the intermediate pocket P and the counterbalancing chamber 262.

The bypass passage 264 is opened, by the axial gas force control means, between the intermediate pocket P and the counterbalancing chamber 262 when the pressure in the intermediate pocket P is not close to a vacuum pressure. In a working example in which the axial gas force control means comprises spring-loaded check valve 266, the cracking pressure of the check valve 266 is set to 1 psig. In this case, compressed gas in the intermediate pocket P will be bypassed into the counterbalancing chamber 262 and thereby act on the back side 230*b* of the orbiting plate 230P of the orbiting plate scroll 230. As a result, the compressed gas will create a counterbalancing gas force on the orbiting plate scroll 230 (as shown by the large arrows in FIG. 2).

Also, a vent 272 may be provided to ensure that the counterbalancing gas force does not overcompensate for the gas force produced in the pockets P constituting the compression stage 260. The vent 272 includes a vent passage 273 extending through the frame 210 and a pressure relief valve 274 disposed in-line with the vent passage 273. The pressure relief valve 274 opens when the counterbalancing gas pressure exceeds a certain value, such as 15 psig. That is, the pressure relief valve 274 may be a spring-loaded check valve (as shown in the figure) having a cracking pressure of 15 psig. In this case, the vent 272 vents the counterbalancing chamber 262 to the ambient (existing around the pump head 200 orpump itself).

Figure 4:
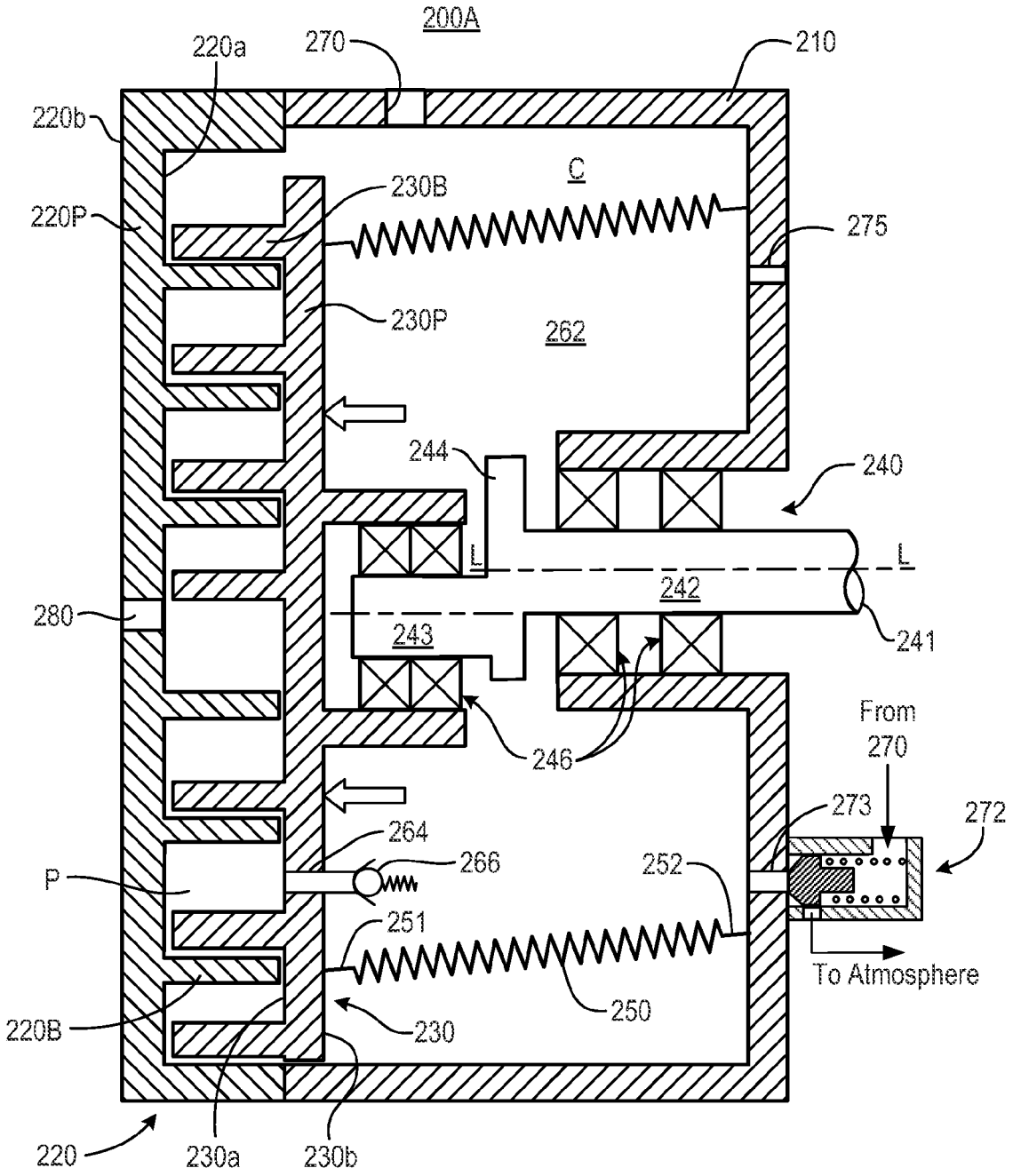
FIG. 4 is a schematic longitudinal sectional view of another type of vent of a pump head of a second embodiment of a scroll pump according to the present invention.

Alternatively, the pump is configured to open the pressure relief valve 274 of the vent 272 when the pressure in the counterbalancing chamber is greater than the pressure in the pump inlet 270 by a predetermined amount. To this end, as shown in FIG. 4, the pressure relief valve 274 may be a pressure-operated valve (e.g., a poppet valve, as shown in the figure) connected by a passageway to the pump inlet 270. Alternatively, the pump may have a pressure sensor that senses that pressure in the pump inlet 270, and the pressure relief valve 274 is solenoid valve or the like operatively connected to the pressure sensor so as to be controlled by the pressure sensor. The advantage of this embodiment is that it limits the pressure-induced stress on the bellows 250 to no more than a certain value, namely, 15 psig in the working example.

Referring back to FIG. 2, the frame 210 may also have a bleed orifice 275 therethrough. The bleed orifice 275 opens into the counterbalancing chamber 262 and allows pressure in the counterbalancing chamber 262 to decay over time when the axial gas force control means (264, 266) closes off communication, via the gas bypass passage 264, between the intermediate pocket P of the compression stage 260 and the counterbalancing chamber 262. This allows the counterbalancing gas force to reduce over time when pressure conditions in the pump inlet 270 change such that the pressure in the inlet 270 is close to vacuum.

Figure 5:
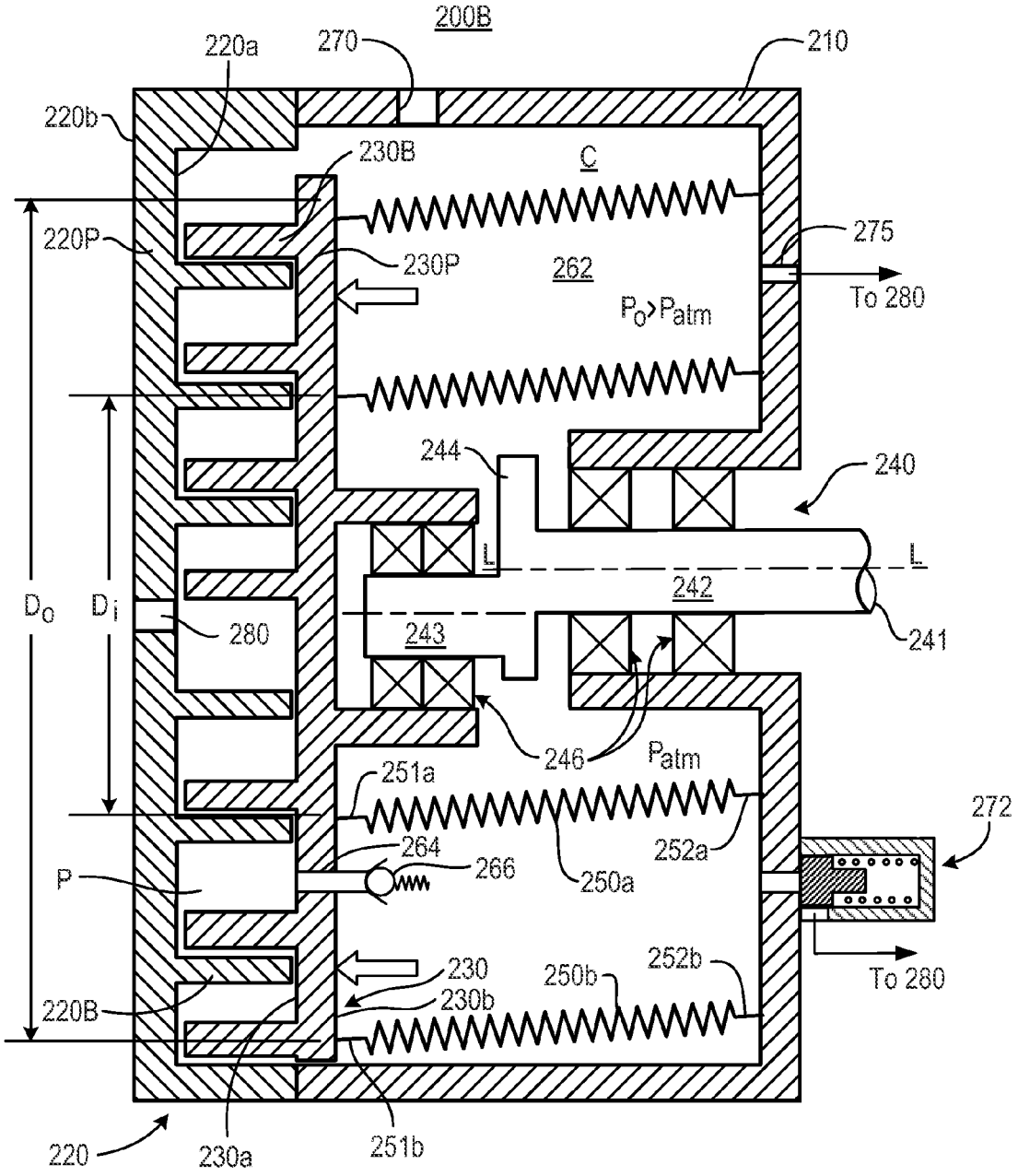
FIG. 5 is a schematic longitudinal sectional view of a pump head of a third embodiment of a scroll pump according to the present invention.

A pump head 200B of another embodiment of a vacuum scroll pump according to the present invention is shown in FIG. 5.

In this embodiment, the pump head 200B has two bellows, namely, a tubular inner bellows 250*a* that extends around the eccentric drive mechanism 240 and a tubular outer bellows 250*b* that extends around the inner bellows 250*a*.

The inner bellows 250*a* has a first end 251*a* connected to the orbiting plate 230P at the back side 230*b* thereof and a second end 252*a* connected to the frame 210. Thus, a space that envelops the eccentric drive mechanism 240 is defined within and delimited by the inner bellows 250*a*. This space is maintained at atmospheric pressure. The tubular outer bellows 250*b*, like the inner bellows 250*a*, has a first end 251*b* connected to the orbiting plate 230P at the back side 230*b* thereof and a second end 252*b* connected to the frame 210. The inlet opening 270 of the pump head 200B opens into the interior of the frame 210 at a location radially outwardly of the outer bellows 250*b*. On the other hand, the counterbalancing chamber 262 is delimited by and between the inner and outer bellows 250*a* and 250*b*.

Accordingly, the counterbalancing gas force applied to the back side 230*b* of the orbiting plate 230P is:

$$F=P_{atm}*\Pi*(D_i/2)^2+P_o*\Pi*((D_o/2)^2-(D_i/2)^2).$$

Furthermore, the inner bellows 250*a* isolates the eccentric drive mechanism 240 from the counterbalancing chamber 262. Accordingly, in the case in which the gas in the counterbalancing chamber 262 is vented through the vent 272, the gas stream flowing through the pump out the vent 272 will not impinge the eccentric drive mechanism 240 (the crank shaft 241, bearings 246, etc.).

FIG. 5 also shows another aspect of the counterbalancing features used in applications in which it is desired to circulate gas through the vacuum scroll pump several times. In these applications, the vent 272 is connected by a passageway directly to the exhaust opening 280 so that the vacuum chamber C is isolated from the surrounding atmosphere by static seals, i.e., the pump is "hermetic". Furthermore, in the case in which a bleed orifice 275 is provided, the orifice 275 is also connected by a passageway directly to the exhaust opening 280. Connecting the vent 272 and/or orifice 275 to the exhaust opening 280 reduces the potential of leaking the outside air into the gas, or leaking the gas into the outside air.

Figure 6:
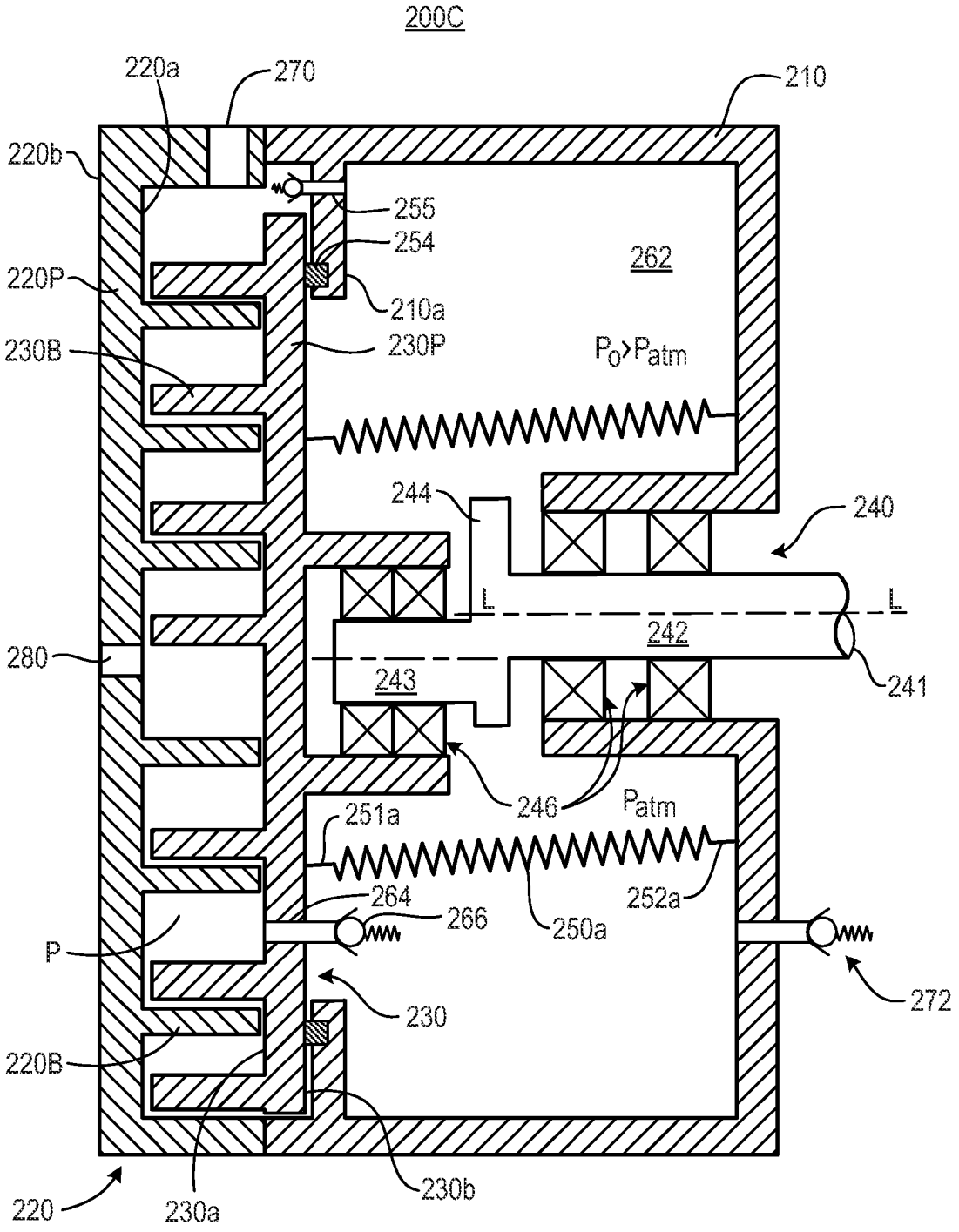
FIG. 6 is a schematic longitudinal sectional view of a pump head of a fourth embodiment of a scroll pump according to the present invention.

A pump head 200C of still another embodiment of a vacuum scroll pump according to the present invention is shown in FIG. 6.

The pump head 200C of this embodiment employs a dynamic seal 254 between the orbiting plate scroll 230P and the frame 210, instead of the outer bellows 250*b* of the previous embodiment. The dynamic seal 254 may be an annular member seated in one of the frame 210 and the back side 230*b* of the orbiting plate 230P of the orbiting plate scroll 230P and slidingly engaged with the other of the frame 210 and the back side 230*b* of the orbiting plate 230P. The annular member is preferably of a plastic material, having good chemical resistance and a low coefficient of friction. Also, the frame 210 may have an extension 210*a* that is juxtaposed with an outer peripheral part of the orbiting plate 230P of the orbiting plate scroll 230 and in this case, the dynamic seal 254 is provided between the extension 210*a* of the frame 210 and the orbiting plate 230P.

Furthermore, in this embodiment, the bellows 250*a* extends around the eccentric drive mechanism 240 so as to isolate the eccentric drive mechanism 240 from the counterbalancing chamber 262, the counterbalancing chamber 262 is defined radially outwardly of the bellows 250*a*, and the dynamic seal 254 seals off the counterbalancing chamber 262 from the compression stage 260 (FIG. 1). In this respect, the pump inlet 140 communicates (via inlet opening 270 of the pump head 200C) with an upstream end of the compression stage 260 as sealed off from the counterbalancing chamber 262 by the dynamic seal 254. Also, the inlet opening 270 of the pump head 200C is shown as extending through the stationary plate scroll 220. However, the inlet opening 270 could instead extend through the frame 210 similarly to the illustrations of the previous embodiments. In this case, though, an inlet passageway (not shown) would extend through the extension 210*a* of the frame connecting the inlet opening 270 to the upstream end of the compression stage 260.

In any case, during operation, the inlet pressure (at 270) adjacent the outer peripheral portion of the orbiting plate scroll 230 will approach the ultimate pressure of the pump. The ultimate pressure is the inlet pressure at which the (intended) pumping flow of gas from the inlet to the outlet is equal to the (unintended) leakage of gas in the reverse direction from the outlet toward the inlet. Therefore, the dynamic seal 254 will have a pressure differential equal to 1 atm or greater across it.

With this in mind, the pump head 200C also has a pressure-compensating relief valve 255 that provides a connection, around the dynamic seal 254, between the counterbalancing chamber 262 and the ingress of the compression stage 260 (FIG. 1). In the illustrated embodiment, the pressure-compensating relief valve 255 has a passageway that extends through the extension 210*a* of the frame 210. The pressure-compensating relief valve 255 allows gas remaining in the region outside the bellows 250*a* and behind the dynamic seal 254 to be pumped out by the compression stage 260 once the inlet pressure falls below the pressure in that region.

Also, the pump head 200C may be configured as described above in connection with the embodiment of FIG. 6 such that the vent 272 is connected to the exhaust opening 280. Moreover, the embodiment of FIG. 6 may also employ a bleed orifice 275 and in the case in which the pump is to be hermetic, that orifice may also be connected to the exhaust opening 280.

Figure 7:
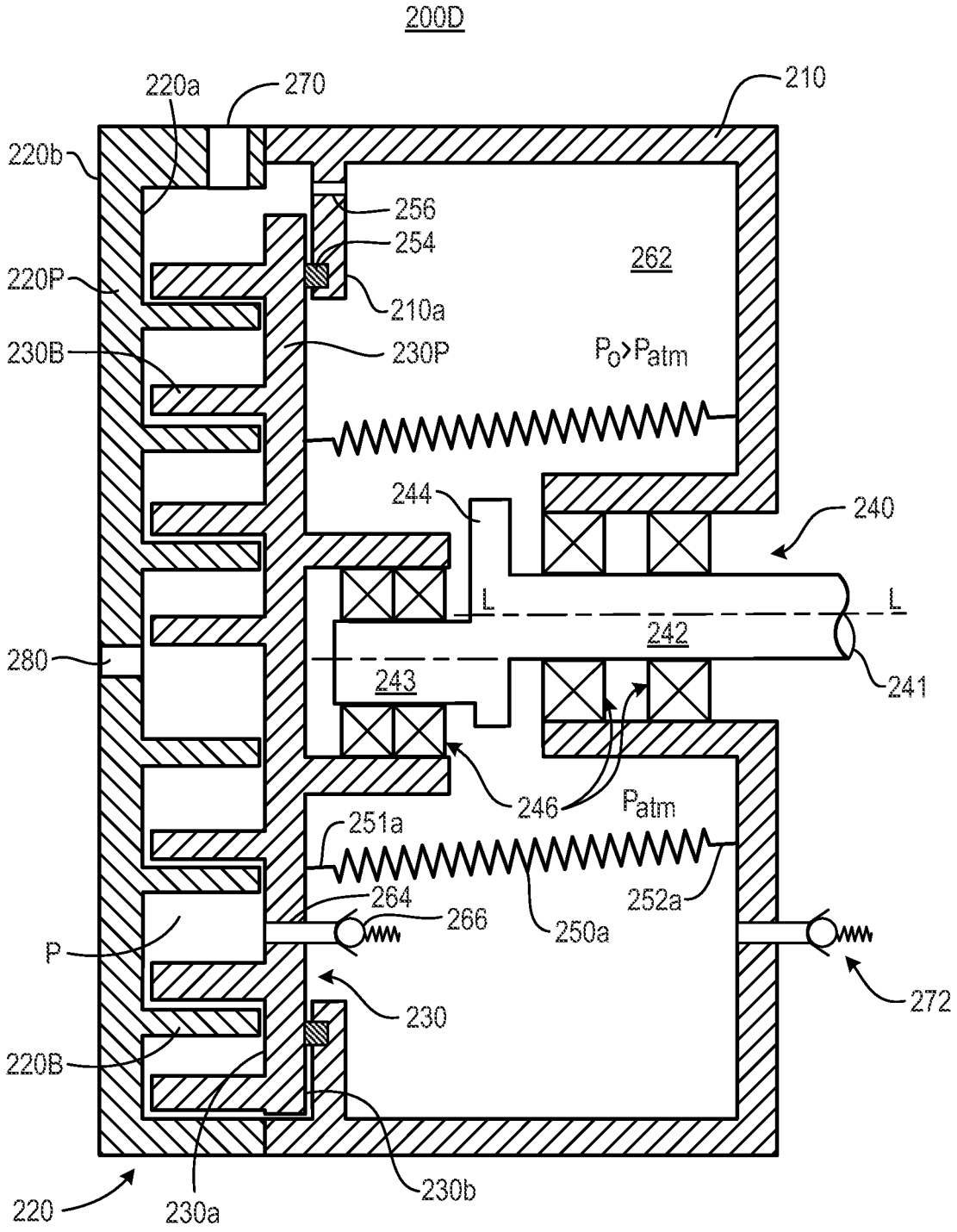
FIG. 7 is a schematic longitudinal sectional view of a pump head of a fifth embodiment of a scroll pump according to the present invention.

In the embodiment shown in FIG. 7, the pump head 200D employs a pressure-compensating relief orifice 256 instead of valve 255. In this case, under conditions of high inlet pressure, the counterbalancing chamber 262 will remain pressurized; under conditions of relatively low inlet pressure, gas in the counterbalancing chamber 262 will be pumped out by the compression mechanism 260 via the orifice 256.

Also, the pump head 200D may be configured as described above in connection with the embodiment of FIG. 6 such that the vent 272 is connected to the exhaust opening 280. Moreover, the embodiment of FIG. 7 may also employ a bleed orifice 275 and in the case in which the pump is to be hermetic, that orifice may also be connected to the exhaust opening 280.

As described above, according to an aspect of the present invention, a controlled pressure is applied to the back side 230*b* of the orbiting plate scroll 230 during periods of high load (relatively high pressure in the compression mechanism 260). Therefore, during such periods of high load the load on the bearings 246 of the eccentric drive mechanism 240 is minimized.

The controlled pressure is produced by virtue of a counterbalancing chamber 262 defined at the back side of the orbiting plate scroll 230 and selectively communicating with an intermediate one of the pockets P of the compression stage 260. In particular, means may be provided so that the pressure in the counterbalancing chamber 262 is increased as a function of the pressure at the inlet of the pump. The higher the inlet pressure, the greater is the force in the counterbalancing chamber 262 that balances the gas forces from the pockets P constituting the compression stage 260 of the scroll pump. Means may also be provided such that the pressure in the counterbalancing chamber 262 will return to atmospheric pressure when the pressure at the pump inlet is below a minimum threshold value.

Preferably, the counterbalancing chamber 262 is defined in part by one or more bellows of the type typically used to isolate an eccentric drive mechanism from a vacuum chamber in a vacuum scroll pump.

Figure 8:
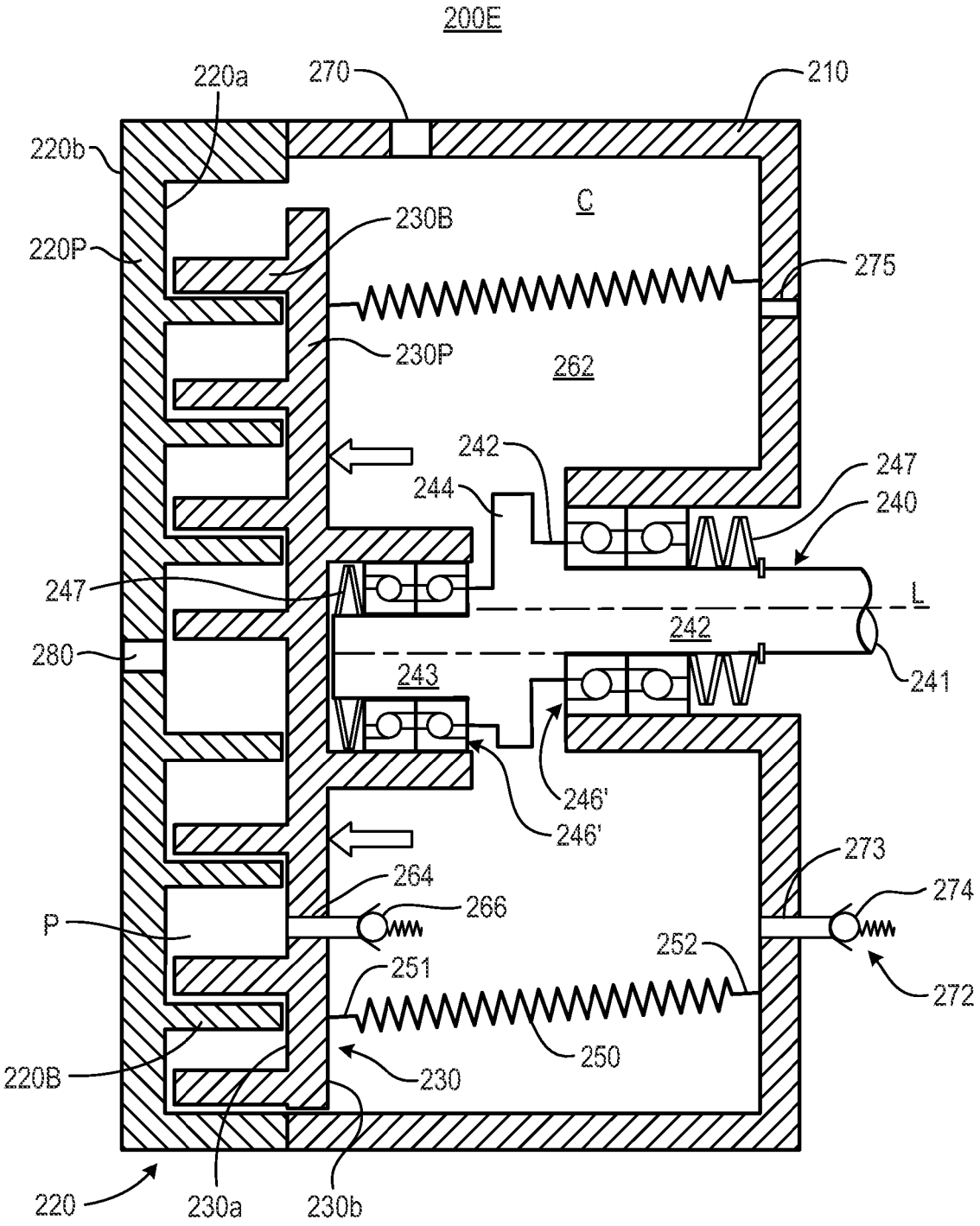
FIG. 8 is a schematic longitudinal sectional view of a pump head of a scroll pump according to the present invention and which employs angular contact bearings.

Such aspect(s) of the invention are particularly advantageous in a vacuum scroll pump whose eccentric drive mechanism employs spring-loaded angular contact bearings, as shown in FIG. 8. A pair of angular contact bearings 246' is provided on the orbiting plate scroll 230 to mount the orbiting plate scroll 230 to the crank 243 and/or a pair of angular contact bearings 246' may be provided on the frame 210 to mount the main portion 242 of the drive shaft 241 to the frame 210. In FIG. 8, reference numeral 247 designates disk (Belleville) springs that preload the angular contact bearings 246'. The springs 247 are retained on the drive shaft 241 by any appropriate means such as spring clips.

The disk springs 247 that preload the angular contact bearings 246' counteract the axial load exerted on the bearings 246' by the bellows 250. Also, note, although FIG. 8 shows a pump head 200E having the counterbalancing features of the first embodiment of FIGS. 1 and 2, the pump head 200E could instead employ the counterbalancing features of any of the pump heads shown in and described with reference to FIGS. 4-7.

If the counterbalancing features 262, 264, 266, etc. were not provided, the spring force exerted by disk springs 247 to counteract the bellows-induced axial load on the angular contact bearings 246' could be quite high, e.g., on the order of 350 lbs. in a working example. This load of 350 lbs., in addition to other axial loads, is constantly borne by the angular contact bearings 246'. Under such conditions the fatigue life of the bearings 246' is drastically reduced.

However, a spring force of only 35 lbs. needs to be exerted on the angular contact bearings 246' when counterbalancing means of the present invention are implemented. In fact in some cases, such as when angular contact bearings 246' mounted to the orbiting plate scroll 230 are used in conjunction with radial bearings instead of angular contact bearings 246' mounted to the frame 210 for supporting the drive shaft 241, a counteracting spring force becomes altogether unnecessary.

In addition, conventional vacuum scroll pumps may employ a vent for the vacuum chamber of the pump head into which gas is drawn by the compression stage. In these pumps, a relatively high axial gas load is exerted on the bearings at the time the pump head is vented. And even though the duration of the event—in which the relatively high axial gas load is exerted on the bearings at the time the pump head is vented—is very short, the event can also drastically reduce the useful life of the bearings.

On the other hand, the present invention can minimize the axial forces constantly borne by the bearings such as the spring forces required to pre-load the bearings, and can also minimize the axial forces exerted on the bearings during temporary events such as when the vacuum chamber is vented. Accordingly, the present invention can prolong the useful life of the bearings of a drive mechanism in a vacuum scroll pump.

Finally, embodiments of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. A vacuum scroll pump, comprising:

an inlet portion having a pump inlet, and an exhaust portion having a pump outlet;

a frame;

a stationary plate scroll fixed to the frame and comprising a stationary plate comprising a central portion, a back side, a front side, and a stationary scroll blade projecting from the front side, wherein the stationary scroll blade has the form of a spiral comprising a plurality of successive wraps emanating from the central portion of the stationary plate;

an orbiting plate scroll comprising an orbiting plate comprising a central portion, a back side, a front side that faces the front side of the stationary plate, and an orbiting scroll blade projecting axially from the front side of the orbiting plate toward the front side of the stationary plate, wherein the orbiting scroll blade has the form of a spiral comprising a plurality of successive wraps emanating from the central portion of the orbiting plate, and wherein the stationary scroll blade and the orbiting scroll blade are nested such that pockets are delimited by and between the stationary scroll blade and the orbiting scroll blade, the pockets being disposed in series between the pump inlet and the pump outlet and collectively constituting a compression stage of the vacuum scroll pump;

an eccentric drive mechanism supported by the frame and operatively connected to the orbiting plate scroll so as to cause the orbiting plate scroll to orbit about a longitudinal axis of the vacuum scroll pump, and the orbiting plate scroll being supported by the eccentric drive mechanism so as to be rotatable about a second axis parallel to the longitudinal axis; and a tubular bellows comprising a first end connected to the orbiting plate at the back side thereof and a second end connected to the frame, wherein an axial counterbalancing chamber is defined within the frame at least in part by the tubular bellows, and is aligned in the direction of the longitudinal axis with part of the back side of the orbiting plate, and the orbiting plate has a gas bypass passage connecting the counterbalancing chamber and an intermediate one of said series of pockets that constitute the compression stage; and axial gas force control means for selectively placing said intermediate one of the pockets in open communication with the counterbalancing chamber and for closing off communication between said intermediate one of the pockets and the counterbalancing chamber, via the gas bypass passage.

2. The vacuum scroll pump as claimed in claim 1, wherein said axial gas force control means is for placing said intermediate one of the pockets in open communication with the counterbalancing chamber when the pressure in the intermediate pocket is greater than atmospheric pressure by at least a predetermined amount.

3. The vacuum scroll pump as claimed in claim 1, wherein said axial gas force control means comprises a spring-loaded check valve disposed in-line with the gas bypass passage between said intermediate one of the pockets and said counterbalancing chamber.

4. The vacuum scroll pump as claimed in claim 1, further comprising a vent that vents the counterbalancing chamber, whereby the vent limits the pressure in the counterbalancing chamber, the vent comprising a vent passage extending through the frame and a pressure relief valve disposed in-line with the vent passage.

5. The vacuum scroll pump as claimed in claim 4, configured to open the pressure relief valve when the pressure in the counterbalancing chamber is greater than the pressure in the pump inlet by a predetermined amount.

6. The vacuum scroll pump as claimed in claim 4, wherein the vent passage connects the counterbalancing chamber to ambient.

7. The vacuum scroll pump as claimed in claim 4, wherein the vent passage connects the counterbalancing chamber to the pump inlet.

8. The vacuum scroll pump as claimed in claim 4, wherein the frame has a bleed orifice therethrough that opens into the counterbalancing chamber, and the bleed orifice allows pressure in the counterbalancing chamber to decay over time when said axial gas force control means closes off communication between said intermediate one of the pockets and the counterbalancing chamber via the gas bypass passage.

9. The vacuum scroll pump as claimed in claim 4, wherein a passageway extends from the vent to the exhaust portion of the pump.

10. The vacuum scroll pump as claimed in claim 1, wherein the frame has a bleed orifice therethrough that opens into the counterbalancing chamber, and the bleed orifice allows pressure in the counterbalancing chamber to decay over time when said axial gas force control means closes off communication between said intermediate one of the pockets and the counterbalancing chamber via the gas bypass passage.

11. The vacuum scroll pump as claimed in claim 10, wherein a passageway extends from the bleed orifice to the exhaust portion.

12. The vacuum scroll pump as claimed in claim 1, wherein:

the tubular bellows extends around the eccentric drive mechanism, the counterbalancing chamber is defined radially inwardly of the tubular bellows, and the pump inlet communicates, outside the tubular bellows, with an upstream end of the compression stage.

13. The vacuum scroll pump as claimed in claim 12, further comprising a vent that vents the counterbalancing chamber, whereby the vent limits the pressure in the counterbalancing chamber, the vent comprising a vent passage extending through the frame and a pressure relief valve disposed in-line with the vent passage.

14. The vacuum scroll pump as claimed in claim 12, wherein the frame has a bleed orifice therethrough that opens into the counterbalancing chamber, and the bleed orifice allows pressure in the counterbalancing chamber to decay over time when said axial gas force control means closes off communication between said intermediate one of the pockets and the counterbalancing chamber via the gas bypass passage.

15. The vacuum scroll pump as claimed in claim 1, wherein the tubular bellows comprises an inner bellows comprising a first end connected to the orbiting plate at the back side thereof and a second end connected to the frame, and an outer bellows comprising a first end connected to the orbiting plate at the back side thereof and a second end connected to the frame, and wherein:

the inner bellows extends around the eccentric drive mechanism, the outer bellows extends around the inner bellows, the counterbalancing chamber is delimited by and between the inner bellows and the outer bellows such that the inner bellows isolates the eccentric drive mechanism from the counterbalancing chamber, and the pump inlet communicates, outside the outer bellows, with an upstream end of the compression stage.

16. The vacuum scroll pump as claimed in claim 1, further comprising a dynamic seal between the orbiting plate scroll and the frame, wherein:

the counterbalancing chamber is defined radially outwardly of the tubular bellows, the tubular bellows extends around the eccentric drive mechanism so as to isolate the eccentric drive mechanism from the counterbalancing chamber, and the dynamic seal seals off the counterbalancing chamber from the compression stage.

17. The vacuum scroll pump as claimed in claim 16, further comprising a vent that vents the counterbalancing chamber, whereby the vent limits the pressure in the counterbalancing chamber, the vent comprising a vent passage extending through the frame and a pressure relief valve disposed in-line with the vent passage.

18. The vacuum scroll pump as claimed in claim 16, further comprising a pressure-compensating relief valve constituting a connection around the dynamic seal that connects the counterbalancing chamber to an upstream end of the compression stage.

19. The vacuum scroll pump as claimed in claim 16, further comprising a pressure-compensating relief orifice constituting a connection around the dynamic seal that connects the counterbalancing chamber to an upstream end of the compression stage.

20. A vacuum scroll pump, comprising:

an inlet portion having a pump inlet, and an exhaust portion having a pump outlet;

a frame;

a stationary plate scroll fixed to the frame and including a stationary plate having a back side and a front side, and a stationary scroll blade projecting from the front side of the stationary plate;

an orbiting plate scroll including an orbiting plate having a back side and a front side that faces the front side of the stationary plate, and an orbiting scroll blade projecting axially from the front side of the orbiting plate toward the front side of the stationary plate;

an eccentric drive mechanism comprising a crankshaft having a main portion supported by the frame and a crank, and spring-loaded angular contact bearings disposed on the crankshaft, the central longitudinal axis of the main portion of the crankshaft coinciding with the longitudinal axis of the pump, the main portion of the crank shaft being connected to a motor so as to be rotated by the motor about its central longitudinal axis, and the central longitudinal axis of the crank being radially offset from that of the main portion; and a tubular bellows having a first end connected to the orbiting plate at the back side thereof and a second end connected to the frame, and wherein the tubular bellows extends around the eccentric drive mechanism, an axial counterbalancing chamber is defined within the frame at least in part by the tubular bellows, and is aligned in the direction of the longitudinal axis with part of the back side of the orbiting plate, the stationary scroll blade has the form of a spiral including a plurality of successive wraps emanating from a central portion of the stationary plate, the orbiting scroll blade has the form of a spiral including a plurality of successive wraps emanating from a central portion of the orbiting plate, the stationary and orbiting scroll blades are nested such that pockets are delimited by and between the stationary scroll blades, the pockets being disposed in series as between the pump inlet and the pump outlet and collectively constituting a compression stage of the pump, and the orbiting plate has a gas bypass passage connecting the counterbalancing chamber and an intermediate one of said series of pockets that constitute the compression stage; and axial gas force control means for selectively placing said intermediate one of the pockets in open communication with the counterbalancing chamber and for closing off communication between said intermediate one of the pockets and the counterbalancing chamber, via the gas bypass passage.

* * * * *